US005102191A

United States Patent [19]

Peng

[11] Patent Number: 5,102,191

[45] Date of Patent: Apr. 7, 1992

[54] COVER-REPLACEABLE CHAIR

[76] Inventor: Jung-ching Peng, 293, Pei Tun Road, Taichung, Taiwan

[21] Appl. No.: 448,549

[22] Filed: Dec. 11, 1989

[51] Int. Cl.[5] ..... C47F 27/00

[52] U.S. Cl. ..... 297/218; 297/440

[58] Field of Search ..... 297/218, 219, 440, 441, 297/444, DIG. 3, 284

[56] References Cited

U.S. PATENT DOCUMENTS

| | | | |
|---|---|---|---|
| 2,374,801 | 5/1945 | Bolick, Sr. | 297/441 X |
| 3,765,719 | 10/1973 | Silver | 297/440 X |
| 3,801,154 | 4/1974 | Hultquist et al. | 297/218 |
| 3,995,892 | 12/1976 | Hollman et al. | 297/218 X |
| 4,510,634 | 4/1985 | Diedrich et al. | 297/444 X |
| 4,523,787 | 6/1985 | Robinson | 297/444 X |
| 4,589,695 | 5/1986 | Bono | 297/DIG. 3 X |

FOREIGN PATENT DOCUMENTS

| | | | |
|---|---|---|---|
| 77125 | 12/1962 | France | 297/218 |

*Primary Examiner*—Jose V. Chen

[57] ABSTRACT

A cover-replaceable chair which comprises a main body which comprises a seat and a backrest each having a cushion-receiving space with a support plate. At least two elastic frames that each includes a cover surface and an inflatable tube locating along and connected with the cover surface. Two positioning frames each has a peripheral opening formed at interior side, a tube-receiving cavity formed inside in order to ensure the inflatable tube to be held in position. Two cushions which inside are formed at least two chambers respectively are placed in the cushion-receiving spaces and rested on the support plates of the seat and backrest respectively. Thus, when the cover surfaces or the cushions have to be changed, flatten the inflatable tubes by the inlets, and take out the inflatable tubes and the cover surfaces, and then flatten the cushions and take out the cushions. To re-assemble a new or different set of cushions, inflate the inflatable tubes to connect with the positioning frames of the seat and backrest, and then inflate the chambers of the two cushions.

1 Claim, 2 Drawing Sheets

COVER-REPLACEABLE CHAIR

BACKGROUND OF THE PRESENT INVENTION

The present invention relates to a chair; more particularly, a new manner to manufacture a cover-replaceable chair.

Accordingly, there are a lot of cover-replaceable chairs available in the market. However, the connecting manners of them are quite different. The present invention does not want to make a revolutionary step in manufacturing a chair, but provides a new manner to make it.

OBJECT OF THE PRESENT INVENTION

Surely, the main object of the present invention is to provide a new manner for manufacturing a cover-replaceable chair.

| A Table of Illustration Numbers | |
|---|---|
| 1- main body | 1a- seat |
| 1b- backrest | 10- positioning frame |
| 11- peripheral opening | 12- tube receiving cavity |
| 13- tube inlet receiving guide | 14- support plate |
| 141- cushion inlet receiving hole | 15- cushion-receiving space |
| 20- cushion | 21- chamber |
| 211- cushion inlet | 30- elastic frame |
| 31- inflatable tube | 311- inlet |
| 312- welt | 32- cover surface |

SUMMARY OF THE PRESENT INVENTION

The present invention provides a new manner for manufacturing a cover-replaceable chair that needs at least two elastic frames which include an inflatable tube with an inlet and a welt; a cover surface which is connected with the welt; two positioning frames which have a peripheral opening, a tube-receiving cavity and a tube inlet receiving guide those ensure the inflatable tube with the inlet to be inserted and held in the position, a support plate with a plurality of cushion inlet receiving holes and a cushion-receiving space; two cushions which inside are formed at least two chambers with at least two cushion inlets on the back of the cushions and inserted to pass through the plurality of cushion inlet receiving holes respectively; and the two cushions are held in position by the two cushion receiving spaces.

BRIEF DESCRIPTION OF THE PRESENT INVENTION

DETAILED DESCRIPTION OF THE PREFERRED EMBODIMENT

Figure 1:
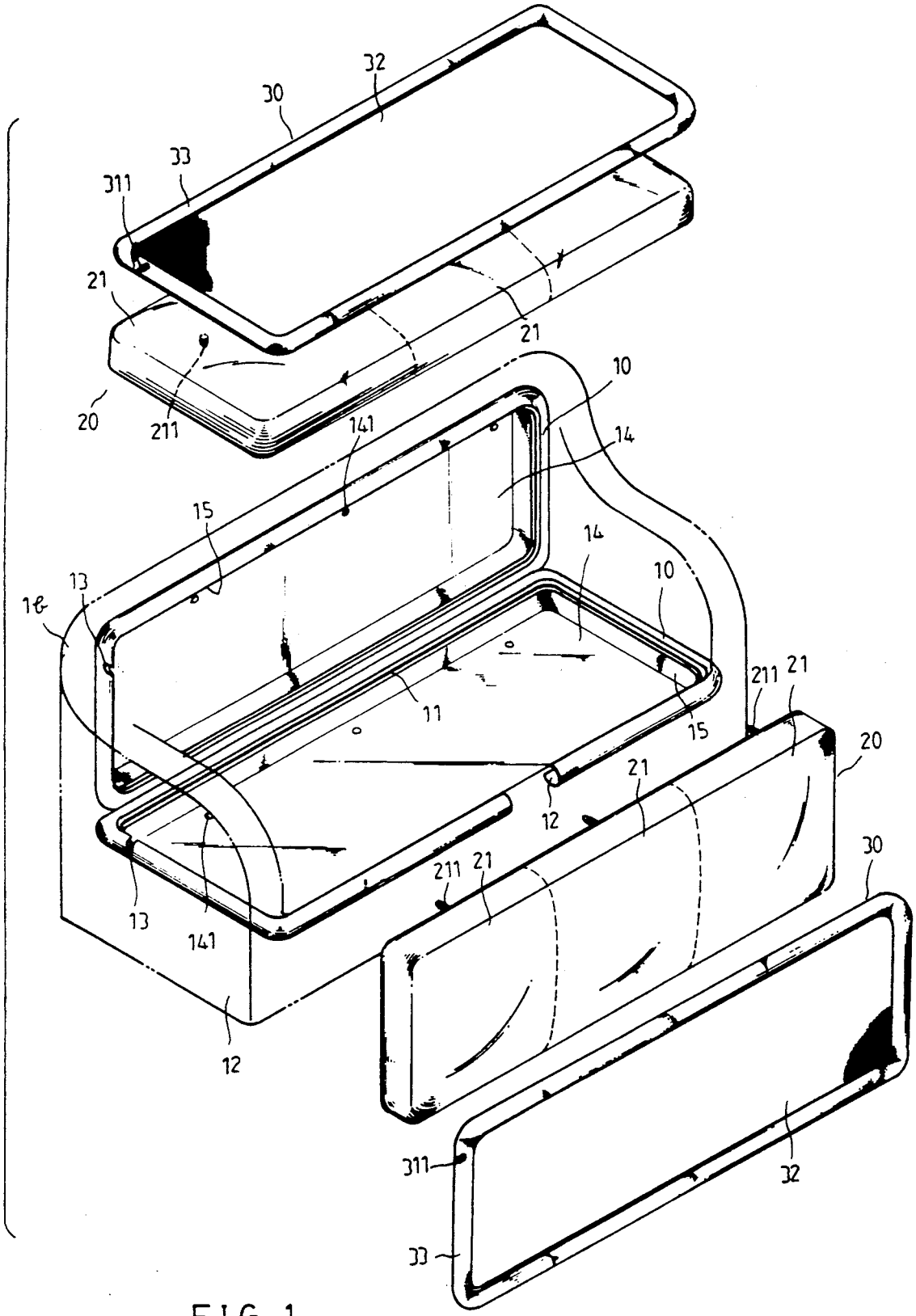
FIG. 1 is an exploded transparent diagram of the preferred embodiment of the present invention.
Figure 2:
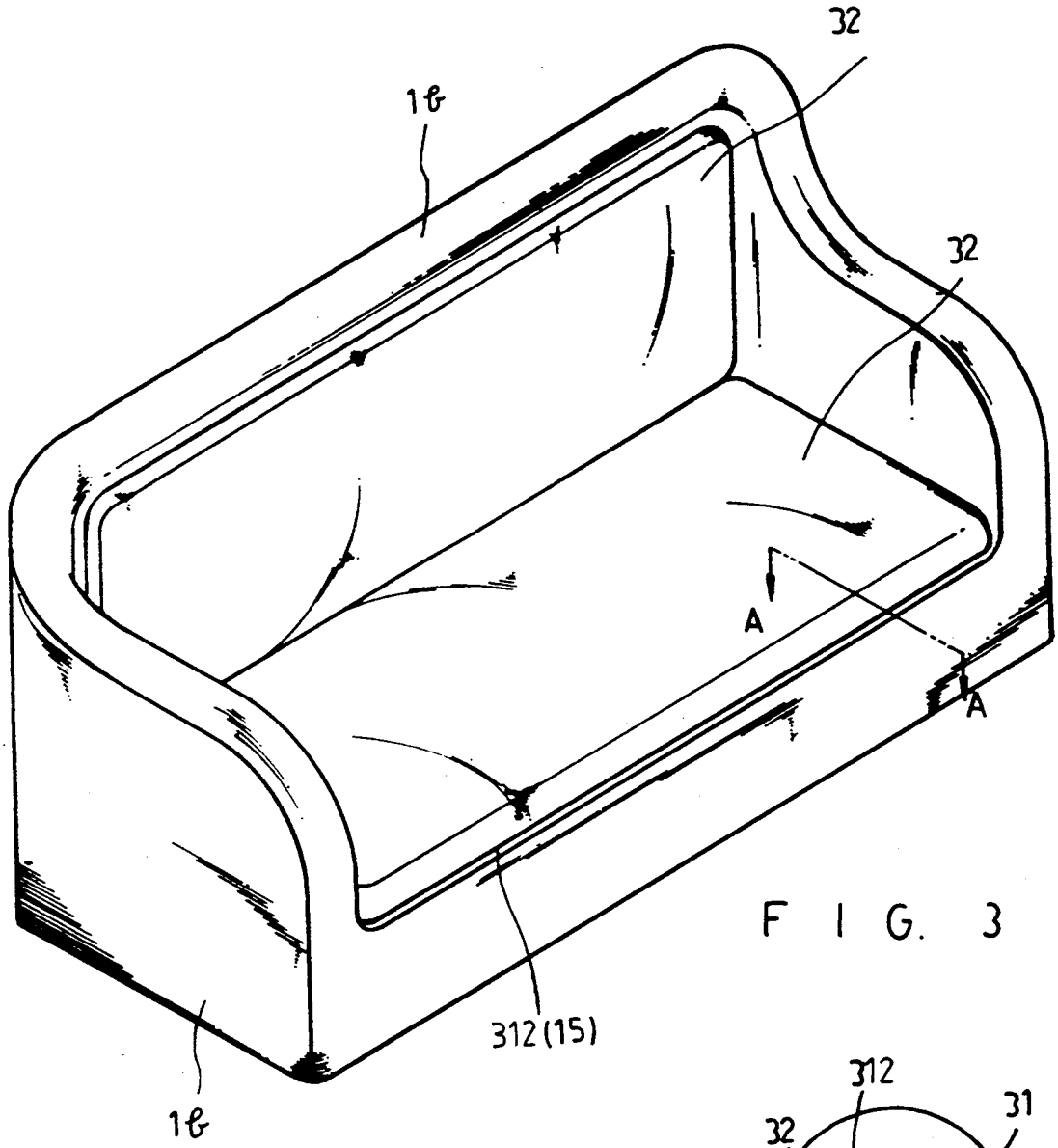
FIG. 2 is an assembled diagram of the preferred embodiment of the present invention.
Figure 3:
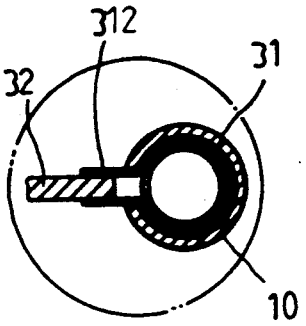
FIG. 3 is a cross-sectional close-up view of the A—A line of the FIG. 2.

Please refer to FIG. 1, here a sofa is cited as an example. In FIG. 1, the present invention provides a main body 1 which comprises a seat 1*a* located horizontally and a backrest 1*b* located vertically. The seat 1*a* and the backrest 1*b* each provides a cushion-receiving space 15 respectively that its bottom surface of each cushion-receiving space 15 forms a support plate 14 with a plurality of cushion inlet receiving holes 141 formed thereon. The plurality of cushion inlet receiving holes 141 on the support plate 14 of the seat 1*a* are formed close to its inner portion. The plurality of cushion inlet 141 on the support plate 14 of the backrest 1*b* are formed close to its upper portion. On the peripheries of the cushion-receiving spaces 15 of the seat 1*a* and backrest 1*b* form a positioning frame 10 respectively. The positioning frame 10 is of a tubular form and comprises a peripheral opening 11 formed at interior side, a tube-receiving cavity 12 formed inside and a slot-shaped tube inlet receiving guide 13 formed at predetermined position of its upper surface.

The insides of the cushions 20 of the seat 1*a* and backrest 1*b* are separated with at least two chambers 21. On the backside of each chamber 21 of the two cushions 20, a cushion inlet 211 is formed.

Two elastic frames 30 respectively comprises a cover surface 32 and an inflatable tube 31 which is located around the cover surface 32 having an inlet 311 located at its exterior side and a welt 312 along its interior side. The cover surface 32 is firmly connected with the welt 312 by means of gluing or sewing.

Operation of the Present Invention

First, make the two cushions 20 rest on the two support plates 14 with the cushion inlets 211 passing through the cushion inlet receiving holes 141 respectively. Then, insert the two inflatable tubes 31 with their inlets 311 and welts 312 and the cover surfaces 32 into the two tube-receiving cavities 12 through the two peripheral openings 11 and place the inlets 311 on the tube inlet receiving guides 13 respectively. Inflate the inflatable tubes 31 with the air or liquid by the inlets 311 until the inflatable tubes 31 firmly connects with the positioning frames 10 of the seat 1*a* and the backrest 1*b* respectively. Finally, inflate the chambers 21 of the two cushions 20 with the air or liquid by the cushion inlets 211 until the cushions 20 firmly rest against the cover surfaces 32 respectively. By the means, the present invention is completed.

When the cover surfaces 32 or the cushions 20 have to be changed, flatten the inflatable tubes 31 by the inlets 311, and take out the inflatable tubes 31 with the inlets 311 and the welts 312 and the cover surfaces 32, and then flatten the cushions 20 by the cushion inlets 211 and take out the cushions 20. Re-assemble a new or different set of cushions 20 with the cushion inlets 211 and two new or different inflatable tubes 31 with the inlets 311 and the welts 312 and a clean or different set of cover surfaces 32 by the above-mentioned manner again. By the means, the cover surfaces of the present invention are replaced.

I claim:

1. A cover-replaceable chair comprising:

a main body which comprising a seat located horizontally and a backrest located vertically;

said seat and backrest each providing a cushion-receiving space respectively that the bottom surface of each cushion-receiving space forming a suport plate with a plurality of cushion inlet receiving holes formed thereon;

the peripheries of said cushion-receiving space of said seat and backrest form a positioning frame respectively;

said positioning frames being in tubular form and each having a peripheral opening formed at an interior side, a tube-receiving cavity formed inside and a slot-shaped tube inlet receiving guide formed at predetermined position of its upper surface;

a seat cushion and a backrest cushion wherein the insides of said two cushions being separated into at least two chambers;

a backside of each chamber of said two cushions forming a cushion inlet respectively which is passed through said cushion inlet receiving holes when said cushions rest on said two support plates of said seat and backrest;

two elastic frames each comprising a cover surface and an inflatable tube located around said cover surface;

said inflatable tube having an inlet located at its exterior side and a welt along its interior side;

said cover surface being firmly connected with said welt by connecting means such as gluing and sewing;

an assembly means for placing said cushion in said cushion-receiving spaces that rest on said support plates of said seat and said backrest with said cushion inlets passing through said cushion inlet receiving holes respectively and to insert said two inflatable tubes into said tube-receiving cavities of said positioning frames through said peripheral openings with said inlets of inflatable tubes resting on said tube inlet receiving guides respectively, and to inflate the air into said inflatable tubes and said chambers of said cushions by said inlets of said inflatable tubes and said cushion inlets respectively until said inflatable tubes and said cushions rest firmly against said tube-receiving cavities and said cover surface respectively; while replacing, flatten the air in said inflatable tubes by said inlets of said inflatable tubes and take out said inflatable tubes with said inlets and welts and cover surfaces from said positioning frames, then flatten the air in said chambers of said cushions by said cushion inlets and take out said cushions from said cushion-receiving space and re-assemble said cover-replaceable chair as said assembly means for placing said cushion in said cushion-receiving spaces again.

* * * * *